United States Patent [19]

Peitl

[11] 3,991,942

[45] Nov. 16, 1976

[54] LONG-RANGE NOZZLE

[75] Inventor: Josef Peitl, Haibach, Austria

[73] Assignee: Vereinigte Osterreichische Eisen- und Stahlwerke - Alpine Montan Aktiengesellschaft, Linz, Austria

[22] Filed: Jan. 2, 1975

[21] Appl. No.: 538,144

[30] Foreign Application Priority Data

Jan. 17, 1974 Austria ..... 358/74

[52] U.S. Cl. ..... 239/566; 239/567

[51] Int. Cl.[2] ..... B05B 1/14

[58] Field of Search..... 239/590.3, 590.5, 598, 239/566, 597, 548, 561, 567; 164/89, 283 R, 283 MS

[56] References Cited

UNITED STATES PATENTS

| | | | |
|---|---|---|---|
| 1,335,267 | 3/1920 | Ambrose et al. | 239/598 X |
| 1,485,495 | 3/1924 | Eldred et al. | 239/561 |
| 2,714,530 | 8/1955 | Shepard | 239/567 X |
| 2,719,581 | 10/1955 | Greathead | 239/566 X |
| 2,997,244 | 8/1961 | Demaison | 239/598 |
| 3,190,562 | 6/1965 | Atwood et al. | 239/548 X |
| 3,423,029 | 1/1969 | Demaison | 239/590.5 X |
| 3,506,197 | 4/1970 | Hensley | 239/566 X |
| 3,739,837 | 6/1973 | Wagstaff et al. | 164/89 X |
| 3,870,232 | 3/1975 | Lacchia | 239/566 X |
| 3,877,510 | 4/1975 | Tegtmeier et al. | 239/598 X |

FOREIGN PATENTS OR APPLICATIONS

| | | | |
|---|---|---|---|
| 1,003,762 | 3/1952 | France | 239/566 |

*Primary Examiner*—Evon C. Blunk
*Assistant Examiner*—Michael Mar
*Attorney, Agent, or Firm*—Brumbaugh, Graves, Donohue & Raymond

[57] ABSTRACT

A long-range nozzle, used in particular for cooling the strand and/or the supporting and guiding rollers of a continuous casting plant by means of liquid jets or liquid and gas jets is provided with a plurality of parallel nozzle channels arranged side by side in one plane. All of the nozzle channels are connected with each other in the area of the mouth of the nozzle by means of a transverse channel that is open in the spraying direction. The transverse channel has two parallel limiting areas. The hydraulic diameter of each channel is 1.5 to 4 mm. The ratio of the hydraulic diameter of each channel to the distance between the two channel axes is 0.7 to 0.9. With the nozzle of the present invention a long range for the spray jet and a close bundling of the spray jet are achieved.

15 Claims, 15 Drawing Figures

LONG-RANGE NOZZLE

BACKGROUND OF THE INVENTION

The invention relates to a long range nozzle, in particular for cooling the strand and/or the supporting and guiding rollers in continuous casting plants by means of jets of liquid or jets of liquid and gas.

In the German Offenlegungsschrift No. 2,208,928 there is described a continuous casting plant for slabs comprising a water-cooled mold, from which the strand is withdrawn continuously, a supporting and guiding zone having rollers between which the strand is guided, and a cooling device having nozzles through which cooling water is sprayed onto the strand and the rollers. The cooling water is supplied by means of flat-section jet nozzles running parallel to the surface of the strand, i.e. to the broad side of the slab, at a distance from the strand surface. The longitudinal axes of the nozzles run parallel to the roller axes. Particularly in continuous casting plants of this type, there is a problem with constructing the flat-section jet nozzles in such a way that far-reaching closely bundled jets are formed with which optionally either the strand surface or the supporting and guiding rollers are acted upon, or with which scale and slag particles can be blown off from the lower side of the slabs.

It is the object of the present invention to provide a long-range nozzle which has various constructional and dimensional features coordinated in such a way that an optimum effect is achieved. The combination of features according to the invention by means of which this object is achieved comprises designing the nozzle to have a plurality, preferably 3 to 10, of parallel nozzle channels arranged side by side in one plane an connecting all of the nozzle channels with each other in the area of the mouth of the nozzle by means of a transverse channel that is open in spraying direction. The transverse channel has limiting areas running parallel to the plane of of the nozzle channels. The hydraulic diameter of each channel is between 1.5 and 4 mm and the ratio of the hydraulic diameter of each channel to the distance between the two channel axes is 0.7 to 0.9.

Preferably the parallel channels of the nozzle are in the form of a line of cylindrical bores with gradually decreasing diameter for the bores closer to the center of the line.

According to a preferred embodiment the water supply is in form of a circular bore and is arranged perpendicular to the plane of the channels and to the annular clearance, so that both the inlet openings and the outlet openings of the channels lie along circular arcs.

A further dimensional feature which is of importance for the close bundling of the jet involves having the ratio of the distance of the parallel limiting areas of the transverse channel to the biggest diameter of the nozzle channels in the range of 1.0 to 1.1.

BRIEF DESCRIPTION OF THE DRAWINGS

In order that the invention may be more fully understood a few embodiments thereof will now be described in more detail with reference to the accompanying drawings.

FIGS. 1 to 4 illustrate a first embodiment of a nozzle according to the invention, wherein FIGS. 1 and 2 show vertical and horizontal sections through the nozzle head, respectively, in relation to each other and FIG. 3 shows a front view.

FIG. 4 illustrates the profile of the water quantity ejected by the nozzle at a certain distance in front of the nozzle mouth.

Finally

DESCRIPTION OF EXEMPLARY EMBODIMENTS

Figure 1:
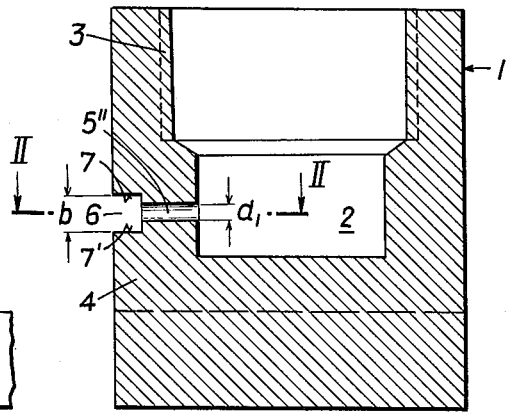
Figure 4:
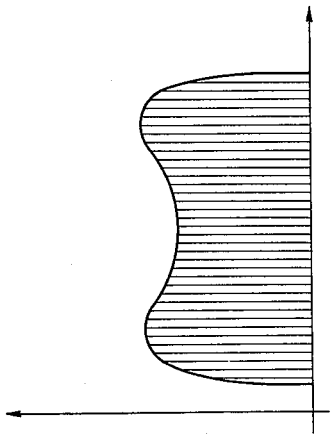
Figure 2:
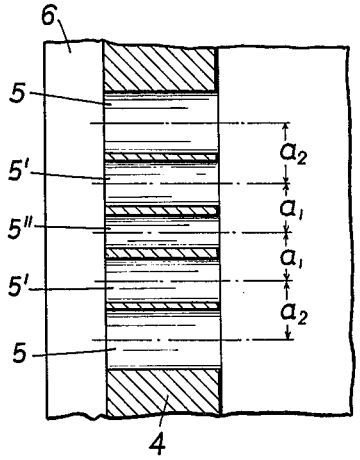
Figure 7:
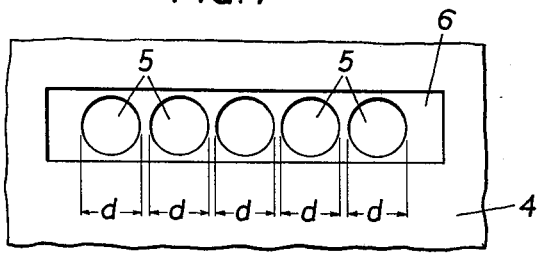
FIGS. 5 to 8 show illustrations of a second embodiment analogous to FIGS. 1-4.
Figure 5:
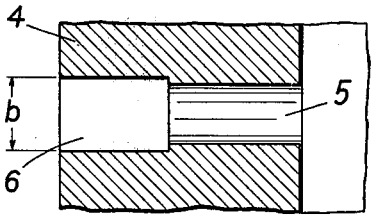
Figure 6:
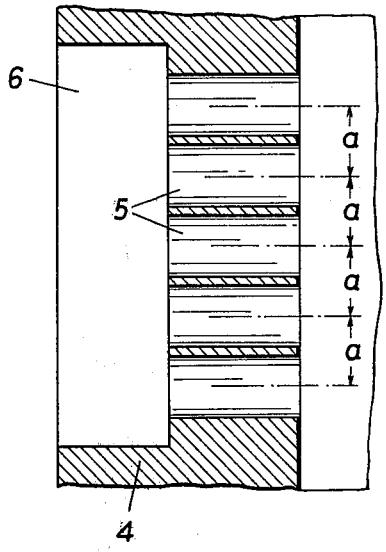

In FIGS. 1 and 2 the nozzle head 1 is provided with a central bore 2 of approximately square cross section. In the upper part of the bore a screw thread for connecting a water supply tube may be provided. In the front wall 4 of the nozzle five parallel nozzle channels are bored in a plane side by side. The two outermost channels 5 have the largest diameter $d_3$ and the diameter of the channels becomes gradually smaller towards the innermost bore i.e. the diameter $d_2$ of the channels 5' is smaller than the diameter $d_3$ of the outermost channels 5 and bigger than the diameter $d_1$ of the central channel 5''. The distance between the nozzle channel axes is denoted with $a_1$ and $a_2$ in FIG. 2. The ratio of the hydraulic diameter $d$ of each channel to the distance $a$ between two channel axes each is designed to be 0.7 to 0.9. All of the channels 5 to 5'' are connected with each other by means of a transverse-running recess 6 in the form of a groove in the nozzle wall 4. This recess is provided with limiting areas 7 and 7' running parallel to the plane of the nozzle channels. The width $b$ of this recess or of the transverse channel is designed to maintain a certain ratio between it and the largest diameter of the nozzle channels, i.e. width $b$ is to be 1.0 to 1.1 times as big as $d_3$. Such nozzles are particularly suited for cooling the rollers in the upper part of the strand guiding zone when the rollers are arranged at relatively large distances from each other. On account of the smaller diameter $d_1$ of the central nozzle of channel 5'' there results a water quantity profile with less water in the middle of the jet ejected, as is illustrated in FIG. 4.

Figure 8:
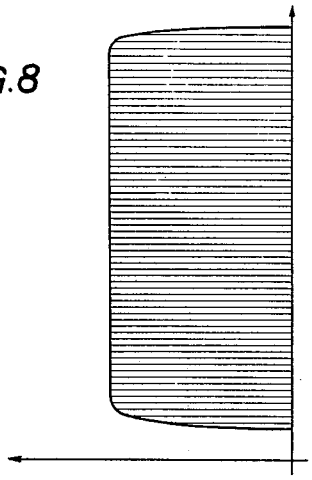

The nozzle according to the the invention shown in FIGS. 5 to 8 is also well suited for cooling the rollers in the upper part of the strand guiding zone. The cylindrical channels 5 have equal diameters $d$ and equal axis distance $a$. Also the transverse channel in the area of the nozzle mouth has a uniform shape, i.e. it has a rectangular cross section. The water quantity profile according to FIG. 8 shows an even distribution.

Figure 9:
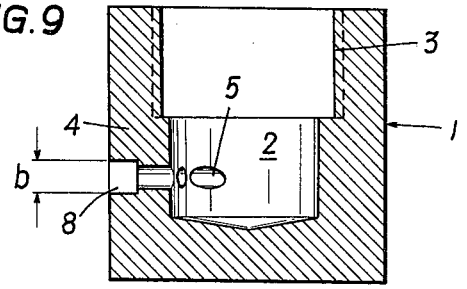
FIGS. 9 and 10 illustrate another embodiment of the nozzle of the invention in in vertical and horizontal sections, respectively in relation to each other.
Figure 10:
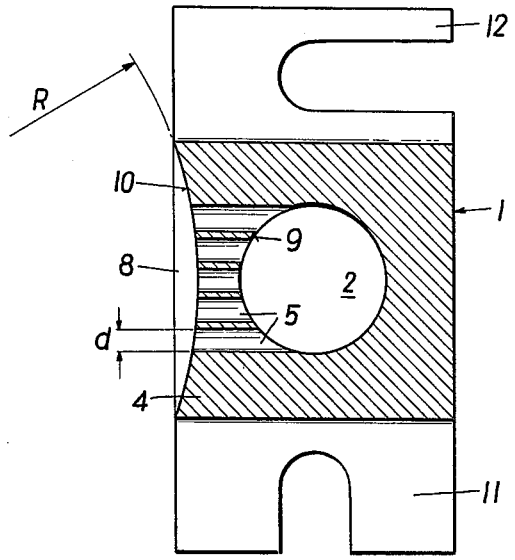
Figure 11:
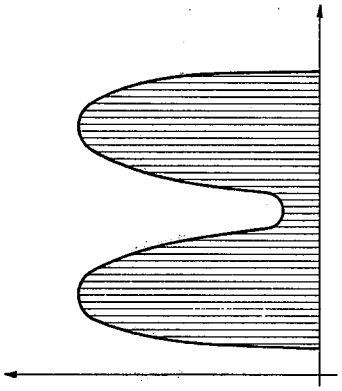
FIG. 11 shows the water quantity profile pertaining to the embodiment of FIGS. 9 and 10.

The nozzle illustrated in FIGS. 9 and 10 is suited for placing cooling agent jets parallel to the strand surface and parallel to the roller axes into the space between the rollers of a continuous casting plant, wherein the strand surface is to be cooled only little, but the rollers are to be cooled intensely. Such nozzles are mainly used for cooling the strand guiding rollers at the outer side of the strand which require jets having a long range and a narrow bundling at a minor slack of the jet and at a water quantity distribution according to FIG. 11. In this preferred embodiment the channels 5 have equal diameters *d* and are connected with each other by an annular groove or clearance 8 provided in the nozzle wall. The center of the radius R for the groove lies in the plane of the channels in front of, i.e. outside, the nozzle so that the central channel is the shortest. When the inner bore 2 is circular, according to the illustration in FIG. 9, both the inlet openings and the outlet openings of the channels lie along circular arcs 9 and 10. The nozzle according to FIGS. 9 and 10 is provided with two securing flanges 11 and 12. A screw thread for the connection of a water supply conduit is denoted with 3.

Figure 12:
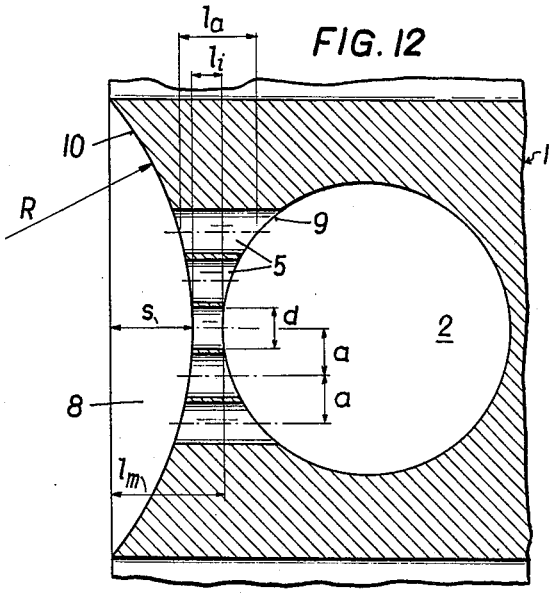
FIG. 12 shows certain dimensional features in a horizontal and delete again section through the nozzle head and FIG. 13 again shows the pertaining profile of the water quantity.

Further dimensional features of nozzles of the invention having an annular clearance in the nozzle wall for connecting the channels can be observed in FIG. 12 which has an enlarged scale. According to this FIG. the shortest channel length $l_i$, the longest channel length $l_a$, the greatest depth *s* of the clearance, the radius R of the ring channel, the diameter of the channels and their axis distance should have certain relations to each other, namely:

| | |
|---|---|
| $l_i : l_a$ | 0.4 to 0.8 |
| $l_i : d$ | maximumly 3 |
| $R : l_m$ | maximumly 15 |

wherein $l_i$ denotes the shortest channel length, $l_a$ the longest channel length, $l_m$ is the sum of shortest channel length and greatest ring channel depth *s* and R denotes the radius of the ring channel.

Figure 3:
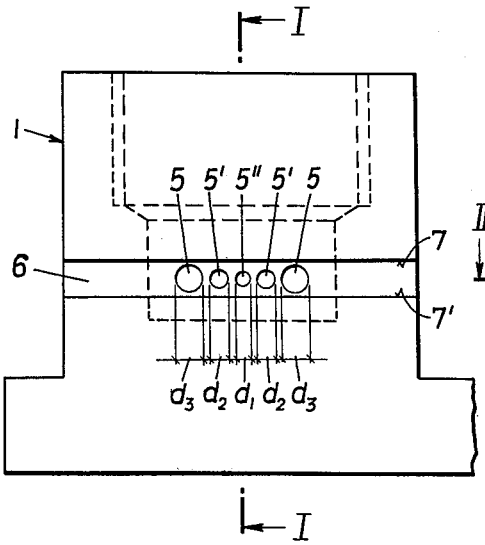
Figure 13:
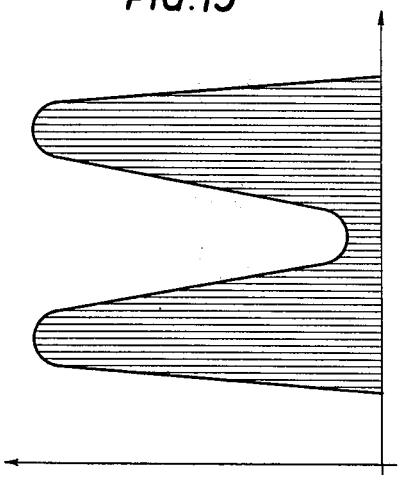

With this embodiment a diameter of the nozzle channels of 1 to 3 mm and a water pressure of 3 kg/cm$^2$ atmospheric excess pressure will produce jet sprays extending for distances in the range of 1.5 to 2.5 m. Relatively fine drops created by the nozzle give the quantity profile according to FIG. 13 and the slack of the jet over a slab width of, for instance, 1.5 m does not amount to more than 1 to 3 cm. The embodiment of the nozzle according to FIGS. 9 and 10 may be modified by dimensioning the diameter of the inner channels smaller than the diameter of the outer channels, in a manner analogous to the one described with reference to FIG. 3.

When this nozzle is modified in such a way that the relation *b : d* is maximumly 1.1 (*b* being the distance of the two limiting areas of the channels) and when for the individual bore a diameter of minimumly 1.5 mm is chosen, an intense cooling of the rollers and, at the same time, the removing of scale deposits below the slab can be achieved because relatively coarse drops having a high energy of impact are formed.

If it is necessary to cool effectively not only the rollers, but also the strand surface, the following dimensioning features are to be recommended.

| | |
|---|---|
| $l_i : l_a$ | bigger than 0.6 |
| $l_i : l_m$ | bigger than 0.6 |
| $l_i : d$ | not smaller than 2.5 |
| $a : d$ | not smaller than 1.2 |
| $b : d$ | 1.0 to 1.1 |
| $R : l_m$ | 10 to 15 , |

wherein $l_i$ is the shortest channel length, $l_a$ is the longest channel length, $l_m$ denotes the sum of the shortest channel length and the deepest depth of the ring channel, *d* is the diameter of the channels, *a* denotes the distance between the channel axes, *b* is the distance of the two limiting areas of the ring channels and R is the radius of the ring channel.

Such nozzles are mainly used in the range of the lower part of the casting arc of a continuous casting plant or in the transition zone from the arc to the horizontal part. Here a water quantity profile is obtained which is similar to that of FIG. 11, wherein more water is conducted on the outer edges of the spray than on the inner edges with a somewhat less exact bundling of the jet a long range of more than 1.5 m with relatively larger drops is achieved.

Figure 14:
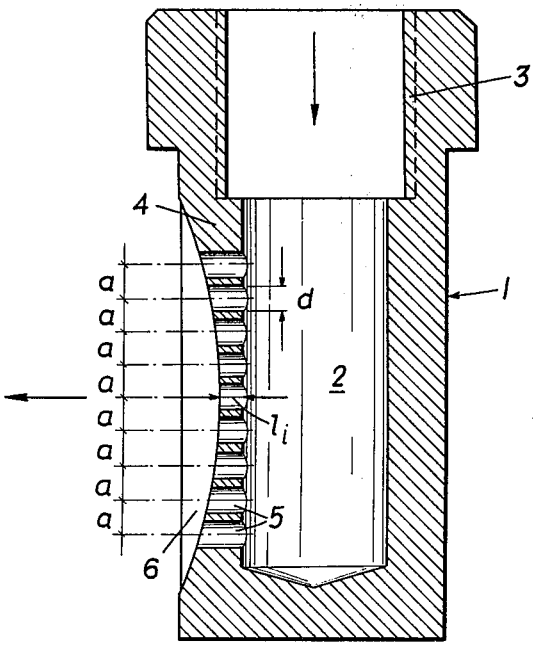
FIGS. 14 and 15 show another embodiment of a nozzle of the invention in a vertical section and in a horizontal section, which nozzle is particularly suited for blowing off slag particles, i.e. a so-called granulating nozzle.
Figure 15:
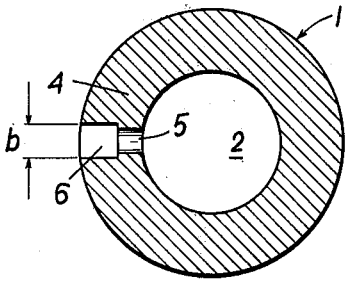

The granulating nozzle illustrated in FIGS. 14 and 15 may be used for cooling hot slabs or it may be used in cutting plants with flame grinding machines for hot sheets or plates in order to avoid scale deposits below the cut or protect the machine parts lying below the cut by causing the burning slag falling through the cut to be granulated and removed cold. The jet guided immediately below the material to be cut is not to touch the material, but is to be kept at a very small distance from it. A preferred nozzle dimensioning for this purpose has the nozzle provided with at least five, preferably seven to ten channels 5, arranged side by side. Also, the relation $l_i : d$ is not greater than 2.5, i.e. relatively short bores are used. The relation *b : d* is again the in the 1.1 range. A high spraying energy at a low slack of the jet and at an exact bundling of the jet is thus achieved.

What I claim is:

1. A long-range spray nozzle for cooling a strand or supporting and guiding rollers in a continuous casting plant by means of liquid jets or liquid and gas jets ejected in front of the area of a mouth of the nozzle, said nozzle comprising:

a plurality of parallel nozzle channels having a certain hydraulic diameter and a certain length, each channel having an axis and an inlet and an outlet opening, said channels being arranged side by side in a plane with the distance between the nozzle channel axes being related to the hydraulic diameter in such a way as to form a closely bundled long-range spray; and a transverse channel open in the spraying direction, said transverse channel having two limiting areas parallel to the plane of the nozzle channels, said transverse channel connecting all nozzle channels with each other in the area of the mouth of the nozzle and the location of the limiting areas with respect to the nozzle channels and the distance between the limiting areas being such that they limit the spread of the spray emanating from the nozzle channels.

2. A nozzle as set forth in claim 1, wherein 3 to 10 parallel nozzle channels are arranged side by side in a plane.

3. A nozzle as set forth in claim 1, wherein the hydraulic diameter of each channel lies between 1.5 and 4 mm.

4. A nozzle as set forth in claim 1, wherein the ratio of the hydraulic diameter of each channel to the distance between two channel axes is 0.7 to 0.9.

5. A nozzle as set forth in claim 1, wherein the parallel channels are in the form of a line of cylindrical bores, and diameter of the channels decreasing for the channels toward the center of the line of bores.

6. A long-range spray nozzle for cooling a strand or supporting and guiding rollers in a continuous casting plant by means of liquid jets or liquid and gas jets ejected in front of the area of a mouth of the nozzle, said nozzle comprising:

a plurality of parallel nozzle channels having a certain hydraulic diameter and a certain length, each channel having an axis and an inlet and an outlet opening, said channels being arranged side by side in a plane with the distance between the nozzle channel axes being related to the hydraulic diameter in such a way as to form a closely bundled long-range spray; and a transverse channel open in the spraying direction and formed by an annular clearance in the area of the mouth of the nozzle, said annular clearance having a certain ring radius and a certain ring channel depth, said transverse channel having two limiting areas lying parallel to the plane of the nozzle channels and having a certain distance from each other which is small enough to limit the spread of the spray emanating from the nozzle channels, said transverse channel connecting all the nozzle channels with each other in the area of the mouth of the nozzle.

7. A nozzle as set forth in claim 6, wherein the ring radius center lies in the lane of the channels, but outside the nozzle, so that the central channel is the shortest.

8. A nozzle as set forth in claim 6, wherein the length of the channels decreases for the channels towards the innermost channel.

9. A nozzle as set forth in claim 6, wherein the ratio of the distance of the parallel limiting areas of the transverse channel to the largest diameter of the nozzle channels is 1.0 to 1.1.

10. A nozzle as set forth in claim 6, wherein the dimensional relationships are $l_i : l_a = 0.4$ to $0.8$ $l_i : d =$ maximumly 3

$R : l_m =$ maximumly 15

$l_i$ being the shortest channel length, $l_a$ being the greatest channel length, $d$ being the hydraulic diameter, $l_m$ being the sum of the shortest channel length and greatest ring channel depth and R being the radius of the ring channel.

11. A nozzle as set forth in claim 6, wherein the dimensional relationships are $l_i : l_a = 0.6$ minimum $l_i : l_m = 0.6$ minimum $l_i : d = 2.5$ minimum $a : d = 1.2$ minimum $b : d = 1.1$ maximum $R : l_m = 10$ to $15$ $l_i$ being the shortest channel length, $l_a$ being the greatest channel length, $l_m$ being the sum of the shortest channel length and the greatest ring channel depth, $d$ being the diameter of the channels, $a$ being the distance between the channel axes, $b$ being the distance between the two limiting areas of the ring channel and R being its radius.

12. A nozzle as set forth in claim 6, wherein said nozzle is provided with at least 5 bores arranged side by side.

13. A nozzle as set forth in claim 6, wherein said nozzle is provided with 7 to 10 bores arranged side by side.

14. A nozzle as set forth in claim 12, wherein the ratio $l_i : d$ is less than 2.5

15. A long-range spray nozzle for cooling a strand or supporting and guiding rollers in a continuous casting plant by means of liquid jets or liquid and gas jets ejected in front of the area of a mouth of the nozzle, said nozzle comprising:

a plurality of parallel nozzle channels having a certain hydraulic diameter and a certain length, each channel having an axis and an inlet and an outlet opening, said channels being arranged side by side in a plane;

a transverse channel open in the spraying direction and formed by an annular clearance having a certain ring radius and a certain ring channel depth, said transverse channel having two limiting areas lying parallel to the plane of the nozzle channels and having a certain distance from each other, said transverse channel connecting all the nozzle channels with each other in the area of the mouth of the nozzle; and a water supply means in the form of a circular bore arranged perpendicularly to the plane of the channels and to the annular clearance, so that both the inlet openings and the outlet openings of the nozzle channels lie along circular arcs.

* * * * *

UNITED STATES PATENT AND TRADEMARK OFFICE

CERTIFICATE OF CORRECTION

PATENT NO. : 3,991,942

DATED : November 16, 1976

INVENTOR(S) : Josef Peitl

It is certified that error appears in the above-identified patent and that said Letters Patent are hereby corrected as shown below:

Column 1, line 18, "siab" should read -- slab --;

Column 1, line 26, delete "from";

Column 1, line 35, "an" should read -- and --;

Column 1, line 46, "diameter" should read -- diameters --;

Column 2, line 8, "respectively" should read -- respectively, --;

Column 2, line 12, delete "and delete again";

Column 2, line 13, delete "again";

Column 2, line 52, "the the" should read -- the embodiment of the --;

Column 2, line 64, "only little" should read -- only a little --;

Column 3, line 5, "wall" should read -- wall 4 --;

Column 3, line 50, after "of the" (second occurrence) insert -- ring channel and d being the diameter of the --;

Column 3, line 58, "." should read -- : --;

Column 4, line 4, "channels" should read -- channel --;

Column 5, line 28, "lane" should read -- plane --.

Signed and Sealed this

Twenty-ninth Day of March 1977

[SEAL]

*Attest:*

RUTH C. MASON
*Attesting Officer*

C. MARSHALL DANN
*Commissioner of Patents and Trademarks*